US006263895B1

(12) United States Patent
Bang

(10) Patent No.: US 6,263,895 B1
(45) Date of Patent: Jul. 24, 2001

(54) QUICK CONNECT SYSTEM

(76) Inventor: Song-Hyuk Bang, #203 Hwangsa Villa, 1452-10, Seocho-Dong Seoul (KR)

( * ) Notice: Subject to any disclaimer, the term of this patent is extended or adjusted under 35 U.S.C. 154(b) by 0 days.

(21) Appl. No.: 09/501,964

(22) Filed: Feb. 10, 2000

(51) Int. Cl.[7] ..... E04H 15/36
(52) U.S. Cl. ..... 135/138; 135/142; 403/109.6
(58) Field of Search ..... 135/121, 139, 135/140, 141, 142, 120.3; 403/109.1, 109.2, 109.3, 109.6

(56) References Cited

U.S. PATENT DOCUMENTS

| | | | |
|---|---|---|---|
| 3,496,950 | 2/1970 | Weber et al. . | |
| 4,247,216 | 1/1981 | Pansini . | |
| 4,558,713 | * 12/1985 | Hagler | 135/120.3 |
| 4,865,065 | 9/1989 | Chen . | |
| 4,869,280 | 9/1989 | Ewing . | |
| 5,139,040 | 8/1992 | Kelly . | |
| 5,217,419 | 6/1993 | Hardwood . | |
| 5,352,057 | 10/1994 | Zody . | |
| 5,482,071 | 1/1996 | Liu . | |
| 5,593,196 | 1/1997 | Baum et al. . | |
| 5,605,170 | 2/1997 | Weng . | |
| 5,702,198 | 12/1997 | Kno . | |
| 5,775,352 | 7/1998 | Obitts . | |
| 5,779,386 | 7/1998 | Eichhorn . | |
| 5,845,664 | 12/1998 | Ryder et al. . | |

* cited by examiner

*Primary Examiner*—Beth A. Stephan
(74) *Attorney, Agent, or Firm*—James R Cwayna

(57) ABSTRACT

A connector system for tubing or piping which provides a male/female combination for the joining of tubes, pipes or the like for rapidly assembling and disassembling various structures such as temporary canopies, tents or the like. The system provides a male member having a spring loaded detent on the interior thereof and extending outwardly thereof with the female member, sized to be received over the male member, having a detent passing aperture through at least one side thereof for effectively and rapidly allowing joinder of units. To erect a supporting structure the connectors are provided at corners or within straight sections to join and extend straight sections. The straight sections are of selected lengths and each end thereof constitutes either a male or female connector for interconnect of the joining elements which may be straight or which may consist of a plurality of joining elements arranged angularly with respect to one another to achieve a corner.

1 Claim, 2 Drawing Sheets

QUICK CONNECT SYSTEM

RELATED APPLICATIONS

Applicant does not have on file nor is he aware of any applications by others currently on file that should be considered in association with the prosecution of this application.

SPONSORSHIP

This invention has been made by the sole efforts of the named applicant and he has not been sponsored nor supported by any Federal or Independent organization.

FIELD OF THE INVENTION

The invention relates generally to a system for the joinder of tubular elements wherein one element provides a male member provided with a spring loaded detent arranged interiorly thereof and extending through the side thereof and a second female element receiving the male element and having a passage through the side thereof to receive the detent of the male member. The system includes a number of connectors including a straight line connector for joining two in-line tubes and including dual or multiple connector wherein the connectors are arranged angularly with respect to one another whereby a corner or bend arrangement for a structure may be established having a number of tubular members emulating therefrom and extending to the next such connector.

SHORT SUMMARY OF THE INVENTION

A quick connect system for joining of pipes or tubes wherein a male element is received into a female element with a spring loaded locking member arranged within the male element and extending through the side thereof to be received into an aperture of the female element wall for releasably locking the two together. Release is achieved by compressing the locking member into the male element to permit the female element to be slid from locked position. The system may be utilized to join straight pipe or tubing sections for extending the same or used to join pip or tubing sections in angular relation to one another by providing corners or bends in a framework for supporting a covering material. The system provides that either the connector members or angularly arranged corner or bend elements may be of the female configuration with interfitting, straight joinder elements being of the male configuration or the system may be modified to have the male and female roles reversed.

BACKGROUND AND OBJECTS OF THE INVENTION

Many different methods have been utilized for joinder of pipes or tubes to effect a quick connect system to provide an effective support structure for a covering material. Such methods include, at least, swedging and compressing of the pipe or tube ends for a friction fit therebetween, providing a set screw or the like through at least the outer member of the system which will secure the inner member therewithin and certain spring loaded detents which are maintained within the male end to extend therethrough and pass through an aperture of a female member received thereabout for releasably locking the two together as well as threading and splitting of the exterior, female member and tightening a nut thereon to compress the female about the male member.

Basically, the Applicant's invention provides improvements on the prior art uses through an arrangement that insures that the friction held, spring loaded detent will be retained in operative position whether engaged with a second element and further that Applicant's concept permits the joinder element to be either male or female to insure the integrity of the structure being erected.

It is therefore an object of the Applicant's invention to provide a quick connect system for the rapid assembly and disassembly of piping or tubing which includes selective male and female end arrangements which provide a spring loaded detent within the male element with the locking or engaging portion extending therethrough to engage with a passage through a mating female member.

It is a further object of the Applicant's invention to provide a quick connect system for piping or tubing wherein a male ended member is provided with a spring loaded detent for engagement with a selected area of a female element and the detent is maintained in operative position within the male ended element through both friction and a retaining device.

These and other objects and advantages of the Applicant's concept will more fully appear from a consideration of the accompanying description and drawings.

DESCRIPTION OF PREFERRED FORMS OF THE INVENTION

In accordance with the accompanying drawings, Applicant illustrates his quick connect concept for the joining of tubing or piping or, in addition, other hollow members which are not necessarily of a round shape but which may be various shapes. If the members consist of units and shapes which will afford a male-female joinder, Applicant's concepts are equally applicable to joinder thereof.

Figure 1:
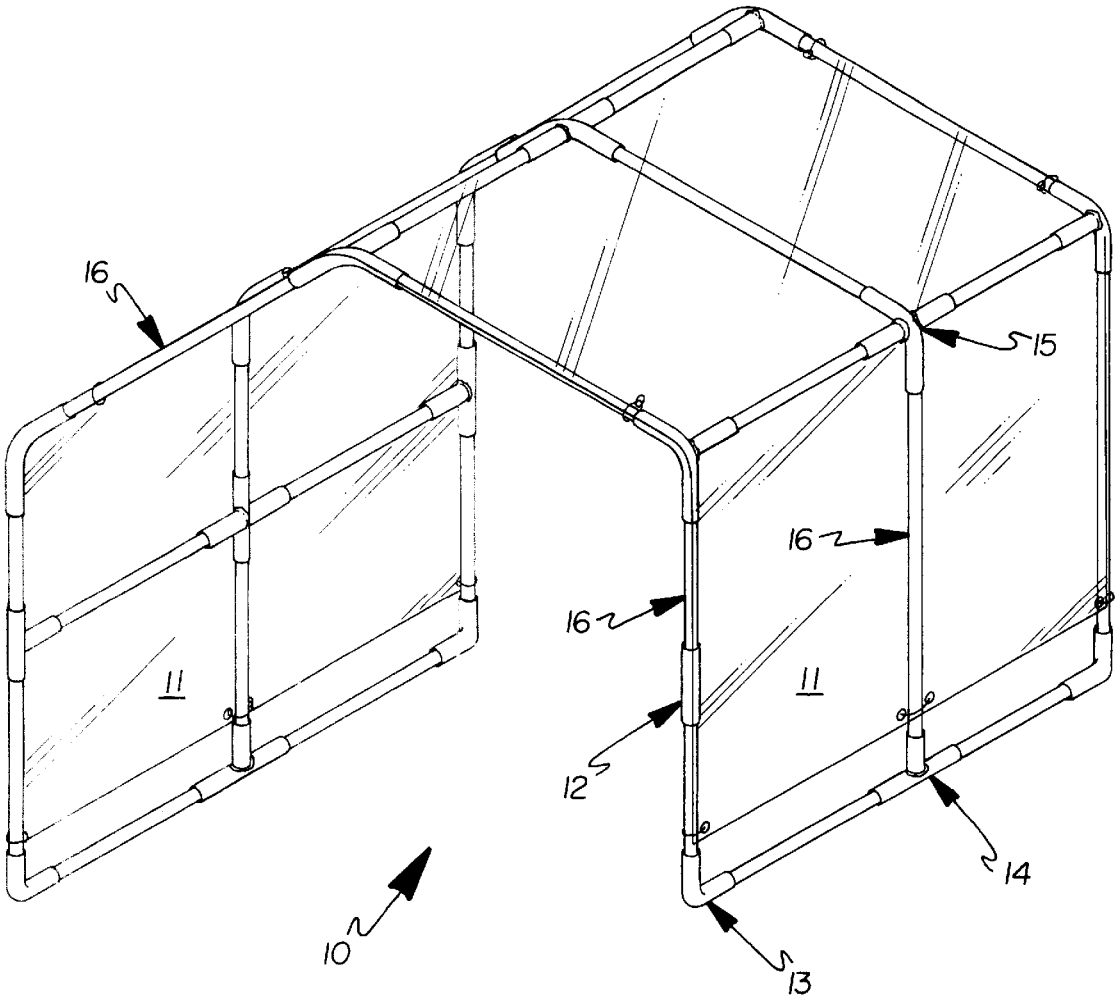
FIG. 1 is a perspective view of a supporting structure provided through provision of the connecting elements which embody the concepts of the Applicant's invention.

As illustrated in FIG. 1 a framework 10 is constructed from male-female elements and is shown with a covering such as a tarpaulin 11 overlying the same. Such an illustration provides a suggestion of uses for the ultimate concept of Applicant which includes the erection of various covering or housing structures.

The framework 10 includes a plurality of connectors including a single, straight line connector 12, a right angle or dual connector 13, a triple connector 14 and a quadruple connector 15. Each of these connectors 12, 13, 14, 15 is joined or joinable with a section of straight tubing or piping 16 each of which is of a selected length to facilitate the structure. A primary concept of the Applicant's invention is to provide connectors which will afford straight line connection or which will afford the angular offset connection of one straight line section 16 to at least a second straight line connector 16 and in most instances to a plurality of other straight line sections as is possible with a triple or quadruple 14, 15 connector.

The concept or any of the connectors is illustrated in the individual views of FIGS. 2, 3, 4 and 5. It should be understood that the basic concept allows for the reversal of parts and therefore reverence to a male portion of a connector always refers to the insertion portion of a connector while the term female portion always refers to the receiving portion of the connector.

Figure 2:
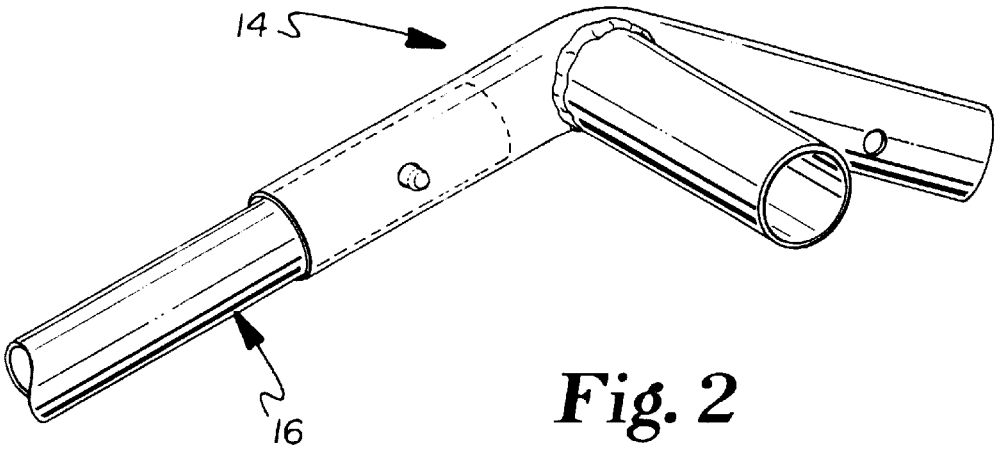
FIG. 2 is a perspective view of one multiple, angular connector member utilized in providing a connective corner of the supporting structure of FIG. 1 and is only illustrative of a single such form of multiple connector.

As illustrated in FIG. 2, a triple connector 14 is illustrated for the joinder of several straight line sections 16, all of which are arranged at angular relations to one another. (One such straight section 16 being shown in FIG. 2.)

Figure 5:
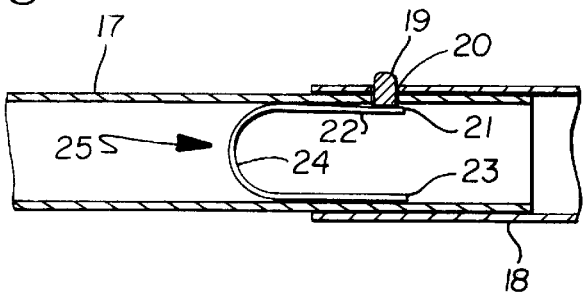
Fig. 5 (PRIOR ART)
Figure 3:
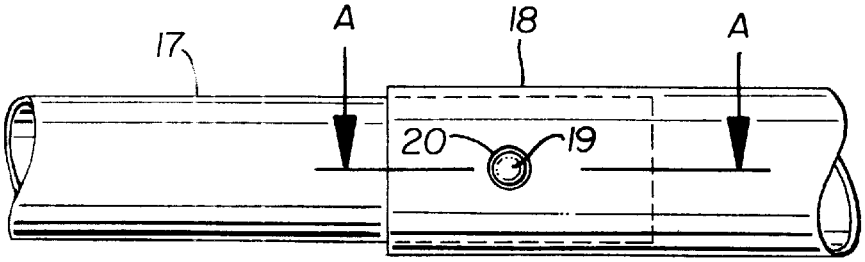
FIG. 3 is a top plan view of a single male end of a connecting pipe or tube.
Figure 4:
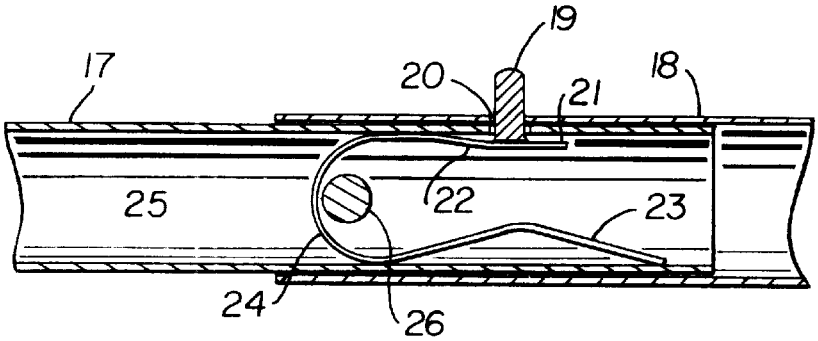
FIG. 4 is a transverse section taken substantially along Line A—A of FIG. 3 and illustrating one form of the spring loaded detent arrangement of the Applicant's concept which incorporates the retention concept of maintaining the detent in position within such end; and, FIG. 5 is a view similar to FIG. 4 illustrating a second form of the spring loaded detent arrangement wherein the detent is maintained within the pipe or tube section only through friction forces and is designated as Prior Art.

As more particularly illustrated in FIGS. 3, 4 and 5, a single connective end of a joinder member is shown with reference being to the male element as 17 and the female element as 18 with the spring loaded detent designated 19 and the aperture through the female element designated 20.

The particular structure for spring loading the detent of each particular embodiment is illustrated in FIGS 4 and 5.

As illustrated in FIG. 4, the spring loaded detent 19 is carried by a normally biased first arm 22 of a formed clip 25 consisting of first arm 22 and second arm 23 which are continuously joined through arcuate portion 24. The spring loaded detent 19 will pass through aperture 21 of male member 17 and subsequently through aperture 20 through female member 18 for releasably locking the members 17, 18 together.

As illustrated in FIG. 4, a retaining arrangement is provided within male member 17 to positively insure the position of the clip 25. As shown therein, clip arm 23 of clip 25 is formed to extend towards arm 22 to provide an area of reduced dimension therebetween. An internal capture or locking member 26 is provided to extend transversely across male member 17 and is secured to the wall or walls of male member 17 through various attachment methods. The diameter of such member, such as a pin 26 is slightly greater than the reduced dimension afforded between clip 25 arms 22, 23 and though the clip 25 is normally held in position by friction of the two arms 22, 23 and coordination of detent 19 to the interior surface walls of male member 17, the pin 26 will positively hold the clip 25 within such area. Clips of this type have been known to be accidentally removed from such locking location and pin 26 prevents such removal.

A more common type of detent mounting is illustrated in FIG. 5. As shown therein, utilizing the same indicia as that of FIG. 4, clip 25 is retained in aperture 20, 21 registration location solely through friction of arms 22, 23 against the inner walls of male member 17.

The Applicant has found that the structure of FIG. 4 has certain advantages over the structure illustrated in FIG. 5.

It should also be noted that the position of the clip 25, in FIGS. 4 and 5 locates the arcuate portion 24 of the clip 25 inwardly of the end of such male member 17. Such clips are equally usable in a reversed position and when in such position, the pin 26 is still present. accidental removal of the same.

As stated, either the male or female configuration of the unit may be afforded as the connector portion or the straight sections of a structure.

As illustrated in FIG. 1, a common structure easily afforded and obtained with the units provided by Applicant consists of a plurality of selected connectors with straight sections of predetermined or cuttable lengths arranged therebetween. The possibilities of obtainable shapes is only determined by the users desires.

Each of the units provided in Applicant's concept then provide a quick connect and disconnect arrangement obtained simply by application of a force to the respective detents that will allow one unit to be slid over the over.

Such a concept eliminates particular tooling to afford complex fitting of straight sections to joinder sections.

What is claimed is:

1. A quick connect system for joinder of piping or tubular elements including:

a) a first of such elements including an insertable male end portion;

b) a second of such elements including a receiving female end portion;

c) said male end portions being receivable into said female end portions;

d) each of said female end portions including a locking aperture through a wall thereof;

e) each of said male end portions including a spring loaded detent interiorly thereof extending through an aperture formed through a wall thereof with said detent being receivable into said locking aperture of said female end portion for joinder of said elements;

f) positioning means for retaining said detent within said male end portion, including a pair of arms normally biased outwardly towards the walls of said male end portion to frictionally engage the walls thereof, said detent being carried by one of said arms and registering with said apertures of said male and female end portions and a stop member arranged transversely across said male end portion received between said arms and of a size to prevent movement of said arms therepast.

* * * * *